US008605125B2

(12) United States Patent
Kim et al.

(10) Patent No.: US 8,605,125 B2
(45) Date of Patent: Dec. 10, 2013

(54) GAMMA CONTROL MAPPING CIRCUIT AND METHOD, AND ORGANIC EMITTING DISPLAY DEVICE

(75) Inventors: In-Hwan Kim, Yongin (KR); Kyoung-Soo Lee, Yongin (KR); Min-Cheol Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 256 days.

(21) Appl. No.: 13/240,841

(22) Filed: Sep. 22, 2011

(65) Prior Publication Data

US 2012/0200608 A1 Aug. 9, 2012

(30) Foreign Application Priority Data

Feb. 8, 2011 (KR) ..... 10-2011-0011167

(51) Int. Cl.
*G09G 3/36* (2006.01)
*G09G 5/10* (2006.01)

(52) U.S. Cl.
USPC ..... 345/690; 345/89

(58) Field of Classification Search
USPC ..... 345/690, 89; 348/671; 382/169; 358/519
See application file for complete search history.

(56) References Cited

U.S. PATENT DOCUMENTS

| | | | | |
|---|---|---|---|---|
| 5,706,058 | A | 1/1998 | Okada | |
| 2003/0098839 | A1* | 5/2003 | Lee | 345/89 |
| 2008/0068404 | A1* | 3/2008 | Ishii | 345/690 |

FOREIGN PATENT DOCUMENTS

| | | | |
|---|---|---|---|
| KR | 10-2003-0079641 | A | 10/2003 |
| KR | 10-2008-0043604 | A | 5/2008 |

* cited by examiner

*Primary Examiner* — Alexander S Beck
*Assistant Examiner* — Ibrahim Khan
(74) *Attorney, Agent, or Firm* — Christie, Parker & Hale, LLP

(57) ABSTRACT

A gamma control data mapping circuit, a mapping method, and a display device using the gamma control data mapping circuit are provided. The gamma control data mapping circuit is for converting input data into grayscale data to display an original image on a display device. The mapping circuit separates the input data into high-order bit data and low-order bit data, and outputs a low-order grayscale boundary and a high-order grayscale boundary by using the high-order bit data. The gamma control data mapping circuit divides a grayscale region defined by the low-order grayscale boundary and the high-order grayscale boundary by a unit grayscale number to calculate unit grayscale data of the grayscale region, multiplies the low-order bit data by the unit grayscale data to calculate linear grayscale data, and adds the low-order grayscale boundary to the linear grayscale data to generate the grayscale data.

11 Claims, 4 Drawing Sheets

GAMMA CONTROL MAPPING CIRCUIT AND METHOD, AND ORGANIC EMITTING DISPLAY DEVICE

CROSS-REFERENCE TO RELATED APPLICATION

This application claims priority to and the benefit of Korean Patent Application No. 10-2011-0011167, filed in the Korean Intellectual Property Office on Feb. 8, 2011, the entire content of which is incorporated herein by reference.

BACKGROUND

1. Field

Aspects of embodiments of the present invention relate to a gamma control mapping circuit, a method thereof, and an organic light emitting diode (OLED) display using the same.

2. Description of Related Art

Among methods that are widely used for a data mapping to control gamma, one such method is to use a look-up table (LUT). When using the LUT, there is often a drawback in that as the number of bits of input data increases, the size of the corresponding LUT increases exponentially. For example, in the case of input data of 10 bits, a LUT of $2^{10}$=1024 cells (that is, one cell for each of 1024 gray levels) may be required. An increase of the LUT in turn causes an increase in the memory size needed.

As operation performance of a controller used in a display device is improved, grayscales of more than 10 bits may be used. However, as the number of bits of the grayscale increases, the corresponding LUT size may exponentially increase. Accordingly, there is a problem that the memory size must be increased with such LUT designs.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention are directed toward a data mapping circuit for gamma control that can accommodate an increase in a number of bits of input data without a corresponding increase in memory size, and a method thereof. Furthermore, an aspect of an embodiment of the present invention is directed toward an organic light emitting diode (OLED) display using the same.

According to an exemplary embodiment of the present invention, a gamma control data mapping circuit for converting input data into grayscale data to display an original image on a display device is provided. The gamma control data mapping circuit includes a boundary calculator and a grayscale data calculator. The boundary calculator is for separating the input data into high-order bit data and low-order bit data, and outputting a low-order grayscale boundary and a high-order grayscale boundary by using the high-order bit data. The grayscale data calculator is for dividing a grayscale region defined by the low-order grayscale boundary and the high-order grayscale boundary by a unit grayscale number to calculate unit grayscale data of the grayscale region, multiplying the low-order bit data by the unit grayscale data to calculate linear grayscale data, and adding the low-order grayscale boundary to the linear grayscale data to generate the grayscale data.

The low-order grayscale boundary and the high-order grayscale boundary may respectively correspond to the high-order bit data and modulation high-order bit data. The modulation high-order bit data may be generated by adding 1 to the high-order bit data.

The boundary calculator may include a separation unit for separating the input data into the high-order bit data and the low-order bit data, an adder for generating the modulation high-order bit data from the high-order bit data, and a look-up table (LUT) for storing a plurality of grayscale boundaries comprising the low-order grayscale boundary and the high-order grayscale boundary, and respectively corresponding to the high-order bit data and the modulation high-order bit data.

The grayscale data calculator may include a subtractor for calculating a difference between the high-order grayscale boundary and the low-order grayscale boundary to calculate the grayscale region, a divider for dividing the grayscale region by the unit grayscale number to calculate the unit grayscale data, a multiplier for multiplying the low-order bit data by the unit grayscale data to calculate the linear grayscale data, and an adder for adding the low-order grayscale boundary to the linear grayscale data to calculate the grayscale data.

In another exemplary embodiment according to the present invention, a method for a gamma control data mapping for converting input data into grayscale data to display an original image on a display device is provided. The method includes separating the input data into high-order bit data and low-order bit data, outputting a low-order grayscale boundary and a high-order grayscale boundary by using the high-order bit data, dividing a grayscale region defined by the low-order grayscale boundary and the high-order grayscale boundary by a unit grayscale number to calculate unit grayscale data of the grayscale region, multiplying the low-order bit data by the unit grayscale data to calculate linear grayscale data, and adding the low-order grayscale boundary to the linear grayscale data to generate the grayscale data.

The low-order grayscale boundary and the high-order grayscale boundary may respectively correspond to the high-order bit data and modulation high-order bit data. The modulation high-order bit data may be generated by adding 1 is to the high-order bit data.

The method may further include generating the modulation high-order bit data from the high-order bit data, and looking up the low-order grayscale boundary and the high-order grayscale boundary by respectively using the high-order bit data and the modulation high-order bit data from a look-up table (LUT) for storing a plurality of grayscale boundaries corresponding to the high-order bit data and the modulation high-order bit data.

In yet another exemplary embodiment of the present invention, a display device is presented. The display device includes a display unit, a data driver, a scan driver, and a controller. The display unit includes a plurality of data lines, a plurality of scan lines, and a plurality of pixels at crossing regions of the data lines and the scan lines, each of the pixels being connected to a corresponding one of the data lines and a corresponding one of the scan lines. The data driver is for transmitting a plurality of data signals to the data lines. The scan driver is for transmitting a plurality of scan signals to the scan lines. The controller is for separating input data into high-order bit data and low-order bit data, outputting a low-order grayscale boundary and a high-order grayscale boundary of a grayscale region corresponding to a range of the input data by using the high-order bit data, multiplying the low-order bit data by unit grayscale data calculated by dividing a difference between the low-order grayscale boundary and the high-order grayscale boundary by a unit grayscale number to calculate linear grayscale data, and adding the low-order grayscale boundary to the linear grayscale data to generate the grayscale data. The data driver is configured to generate the plurality of data signals according to the grayscale data.

The low-order grayscale boundary and the high-order grayscale boundary may respectively correspond to the high-order bit data and modulation high-order bit data. The modulation high-order bit data may be generated by adding 1 to the high-order bit data.

The controller may include a separation unit for separating the high-order bit data and the low-order bit data among the input data, an adder for generating the modulation high-order bit data from the high-order bit data, and a look-up table (LUT) for storing a plurality of grayscale boundaries comprising the low-order grayscale boundary and the high-order grayscale boundary, and respectively corresponding to the high-order bit data and the modulation high-order bit data.

The controller may include a subtractor for calculating a difference between the high-order grayscale boundary and the low-order grayscale boundary to calculate the grayscale region, a divider for dividing the grayscale region by the unit grayscale number to calculate the unit grayscale data, a multiplier for multiplying the low-order bit data by the unit grayscale data to calculate the linear grayscale data, and an adder for adding the low-order grayscale boundary to the linear grayscale data to calculate the grayscale data.

Embodiments of the present invention provide for a data mapping method for gamma control where an increase in a number of bits of input data does not cause a corresponding increase in a memory size. Furthermore, in embodiments of the present invention, an organic light emitting diode (OLED) display using the mapping method and a gamma control mapping circuit using the mapping method are provided.

DETAILED DESCRIPTION

Figure 1:
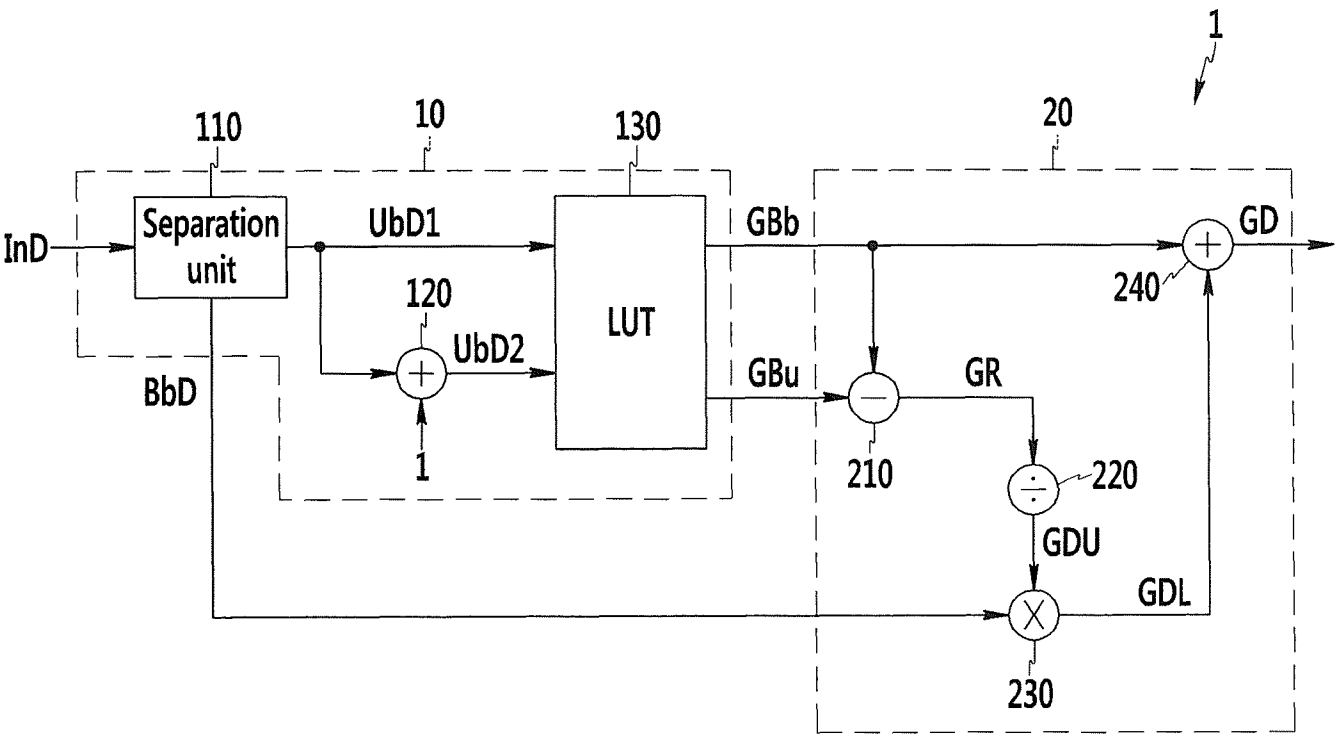
FIG. 1 is a view showing a gamma control mapping circuit according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through one or more third elements. In addition, unless explicitly described to the contrary, the word "comprise" and variations such as "comprises" or "comprising" will be understood to imply the inclusion of stated elements but not the exclusion of any other elements.

Further, the term "gray level" refers generally to an input data value that has been converted into a value appropriate to drive a data driver to display a pixel at a level corresponding to the input data value. Speaking generally, there is one gray level for every possible input data value. However, when used as an adjective to qualify another item (e.g., "data"), the term "gray level" may sometimes be expressed as "grayscale" in the specification with the meaning apparent from context.

Exemplary embodiments of the present invention that can be realized by a person of ordinary skill in the art will now be described with reference to the accompanying drawings.

To display an original image on a display device, input data must be converted into data suitable for the display device. Part of this conversion may include a gamma control data mapping member to correspond the input data to the data suitable (that is, the gray level) for the display device. The data suitable for the display device refers to data representing a data signal output from a controller or data driver of the display device to realize a grayscale (or gray level) for the input data in the original image, and is referred to as grayscale data (or gray level data) hereafter. The input data and the corresponding grayscale data are different according to the gamma characteristics of the display device.

In more detail, when the gamma characteristic is linear, a linear relationship exists between the input data and the grayscale data. Likewise, when the gamma characteristic is non-linear, a non-linear relationship exists between the input data and the grayscale data.

The input data is changed to the grayscale data according to gamma control data mapping, and the controller of the display device generates the data signal according to the grayscale data. The corresponding data signals are applied to a plurality of pixels forming the display device, so when the plurality of pixels emit light, the original image is displayed.

FIG. 1 is a view showing a gamma control mapping circuit 1 according to an exemplary embodiment of the present invention.

As shown in FIG. 1, the gamma control mapping circuit 1 includes a boundary calculator 10 and a grayscale data calculator 20.

The gamma control mapping circuit 1 detects a high-order grayscale boundary GBu and a low-order grayscale boundary GBb of a grayscale region corresponding to a range of input data InD using high-order bit data UbD1 among the input data InD, and calculates unit grayscale data GDU of a grayscale region GR corresponding to the range of the input data InD by using the high-order grayscale boundary GBu and the low-order grayscale boundary GBb. The gamma control mapping circuit 1 multiples the low-order bit data BbD by the unit grayscale data GDU to calculate linear grayscale data GDL, and adds the low-order grayscale boundary GBb to the linear grayscale data GDL to generate the grayscale data GD.

The boundary calculator 10 separates the input data InD into the high-order bit data UbD1 and the low-order bit data BbD, and outputs the low-order grayscale boundary GBb and the high-order grayscale boundary GBu that respectively correspond to the high-order bit data UbD1 and the modulation high-order bit data UbD2 (which is obtained by adding 1 to the high-order bit data UbD1).

The boundary calculator 10 includes a separation unit 110, an adder 120, and a look-up table (LUT) 130.

The separation unit 110 separates the input data InD into the high-order bit data UbD1 and the low-order bit data BbD. In an exemplary embodiment of the present invention, the high-order bit data UbD1 is the high-order 3 bits [9:7] among 10 bits [9:0] of the input data InD, and the low-order bit data BbD is the low-order 7 bits [6:0] among the 10 bits [9:0]. The present invention is not limited thereto.

The adder 120 adds 1 to the final bit of the high-order bit data UbD1 to generate the modulation high-order bit data UbD2. For example, when the high-order bit data UbD1 is "100", the modulation high-order bit data UbD2 becomes "101".

The high-order bit data UbD1 and the modulation high-order bit data UbD2 that are respectively input to the LUT 130 are output as the corresponding low-order grayscale boundary GBb and high-order grayscale boundary GBu. The low-order grayscale boundary GBb is the data representing the lowest limit of the grayscale region corresponding to the range of the input data InD, and the high-order grayscale boundary GBu is the data representing the highest limit of the grayscale region corresponding to the range of the input data InD.

The corresponding relationship in the LUT 130 will be described with reference to FIG. 2.

Figure 2:
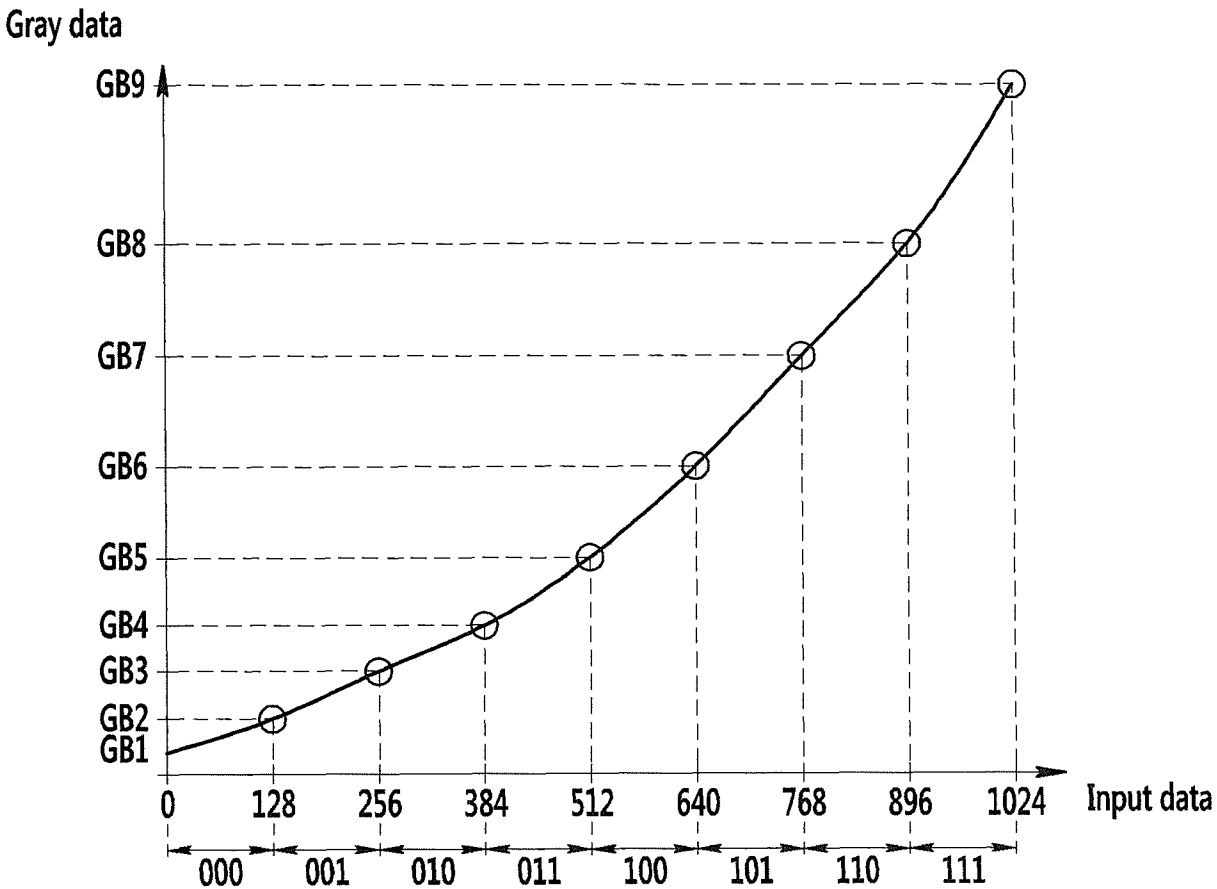
FIG. 2 is a gamma characteristic curve showing a corresponding relationship between input data and grayscale data according to an exemplary embodiment of the present invention.

FIG. 2 is a gamma characteristic curve representing a corresponding relationship between input data and grayscale data according to an exemplary embodiment of the present invention. In FIG. 2, the horizontal axis is the input data InD and may, for example, be 10-bit data, while the vertical axis is the grayscale data GD and may also be 10-bit data. To express the gamma characteristic curve shown in FIG. 2, the high-order bit data UbD1 is set up as 3 high-order bits. However, when a turning point is further needed according to the degree of non-linearity of the gamma characteristic curve, the high-order bit data UbD1 may be more bits than the 3 high-order bits (e.g., the high-order bit data UbD1 may be the 4 high-order bits).

The total number of gray levels expressed by the 10-bit data of the input data InD is 1024, and is equally divided into eight grayscale regions. The high-order bit data UbD1 may be one of "000", "001", "010", "011", "100", "101", "110", and "111". As shown in FIG. 2, one grayscale region GR among the eight grayscale regions is determined according to the high-order bit data UbD1.

The grayscale region GR is one of a number (for example, a predetermined number) of regions that constitute the input InD. That is, the entire grayscale range represented by the input data InD is divided into the (predetermined) number of regions. In the exemplary embodiment of FIG. 2, eight grayscale regions are illustrated, however the present invention is not limited thereto. The eight grayscale regions in FIG. 2 respectively correspond to the difference (that is, the 128 separate gray levels) between the neighboring grayscale boundaries GB2-GB1, GB3-GB2, GB4-GB3, GB5-GB4, GB6-GB5, GB7-GB6, GB8-GB7, and GB9-GB8.

In further detail, the LUT 130 stores a plurality of grayscale boundaries GB1-GB9 corresponding to the high-order bit data UbD1 and the modulation high-order bit data UbD2. The grayscale boundaries GB1-GB9 consist of or include a grayscale boundary GB1 representing the grayscale data corresponding to the input data "0000000000" 0 (that is, a lowest value of the input data InD), a grayscale boundary GB2 representing the grayscale data corresponding to the input data "0010000000" (128, that is, input data InD whose high-order 3-bit value is "001" and remaining bits are 0), a grayscale boundary GB3 representing the grayscale data corresponding to the input data "0100000000" (256), a grayscale boundary GB4 representing the grayscale data corresponding to the input data "0110000000" (384), a grayscale boundary GB5 representing the grayscale data corresponding to the input data "1000000000" (512), a grayscale boundary GB6 representing the grayscale data corresponding to the input data "1010000000" (640), a grayscale boundary GB7 representing the grayscale data corresponding to the input data "1100000000" (768), a grayscale boundary GB8 representing the grayscale data corresponding to the input data "1110000000" (896), and a grayscale boundary GB9 representing the grayscale data corresponding to 1024, which is 1 more than the largest value of the input data InD, namely "1111111111" (1023). The grayscale boundary GB9 is the grayscale data corresponding to the highest value of the modulation high-order bit data UbD2.

The high-order bit data UbD1 is mapped to one of a plurality of grayscale boundaries GB1-GB8. The modulation high-order bit data UbD2 is obtained by adding 1 to the high-order bit data UbD1 such that the modulation high-order bit data UbD2 is mapped to one of a plurality of grayscale boundaries GB2-GB9. For example, if the high-order bit data UbD1 is "011", the low-order grayscale boundary GBb that is mapped and detected by the LUT 130 is the grayscale boundary GB4, and the high-order grayscale boundary GBu is the grayscale boundary GB5.

Referring back to FIG. 1, the grayscale data calculator 20 divides the grayscale region GR by a unit grayscale number (for example, the number of gray levels in the grayscale region, which is 128 in the embodiment of FIG. 2) to calculate the unit grayscale data GDU of the grayscale region GR corresponding to the range of the input data InD having the same high-order bit data UbD1, multiplies the low-order bit data BbD by the unit grayscale data GDU to calculate the linear grayscale data GDL, and adds the low-order grayscale boundary GBb to the linear grayscale data GDL to generate the grayscale data GD. The unit grayscale number refers to the amount of input data InD respectively corresponding to each of the eight grayscale regions. In an exemplary embodiment of the present invention, the eight grayscale regions correspond to the input data InD of the same high-order 3-bit number, that is, the input data InD of $2^7$=128 consecutive input data values.

The grayscale data calculator 20 includes a subtractor 210, a divider 220, a multiplier 230, and an adder 240. The subtractor 210 calculates the difference between the high-order grayscale boundary GBu and the low-order grayscale boundary GBb to calculate the grayscale region GR. The divider 220 divides the grayscale region GR by the unit grayscale number to calculate the unit grayscale data GDU. The multiplier 230 multiples the low-order bit data BbD by the unit grayscale data GDU to calculate the linear grayscale data GDL. The adder 240 adds the low-order grayscale boundary GBb to the linear grayscale data GDL to finally calculate the grayscale data GD.

The gamma control data mapping circuit according to an exemplary embodiment of the present invention includes (as a first step) calculating the high-order grayscale boundary GBu and the low-order grayscale boundary GBb of the grayscale region GR corresponding to the range of the input data InD having the same high-order bit data UbD1, and (as a second step) calculating the grayscale data GD by using the calculated high-order grayscale boundary GBu and the low-order grayscale boundary GBb. The LUT used in the first step includes the $2^n$+1 grayscale boundaries when the high-order bit data UbD1 is n bits. The "+1" in "$2^n$+1" is to account for the grayscale boundary corresponding to the highest high-order bit data UbD1. In addition, the "n" in "$2^n$+1" is determined according to the number of input data bits and the degree of non-linearity of the gamma characteristic curve (for example, the less linear the curve, the larger the value of n).

That is, to realize the nonlinearity of the gamma characteristic, the number of grayscale boundaries GB of the LUT is set and the number of bits of the high-order bit data UbD1 representing the number of grayscale boundaries is determined. For example, the input data InD according to an exemplary embodiment of the present invention is determined as 10-bit data, and the grayscale data GD is also determined as 10-bit data. When the turning point of the gamma characteristic curve representing nonlinearity is 8 (that is, 8 linear grayscale regions provide a sufficient approximation to the gamma characteristic curve), the high-order bit data UbD1 is set up as 3 bit data, since $2^3=8$.

However, the present invention is not limited thereto, and when it is needed to increase the turning point representing the nonlinearity, the high-order bit data UbD1 may be set up as a larger number of bits than the 3-bit data. Likewise, when it is needed to decrease the turning point, the high-order bit data UbD1 may be set up as a smaller number of bits than the 3-bit data.

In the second step, as an approximation, it is assumed that the gamma characteristic between the neighboring grayscale boundaries is linear. Accordingly, the grayscale region GR is divided by the unit grayscale number to calculate the unit grayscale data GDU.

As described above, an exemplary embodiment of the present invention realizes the nonlinearity by using the LUT in the first step to determine the appropriate grayscale boundaries, and then calculates the grayscale data GD corresponding to the input data InD (and without using the LUT) in the second step. Accordingly, the number of grayscale values (in this case, the boundaries) stored in the LUT for this two-step process may be decreased significantly compared with solutions storing one grayscale value for each possible input data value.

Next, an organic light emitting diode (OLED) display according to an exemplary embodiment of the present invention will be described with reference to FIG. 3.

Figure 3:
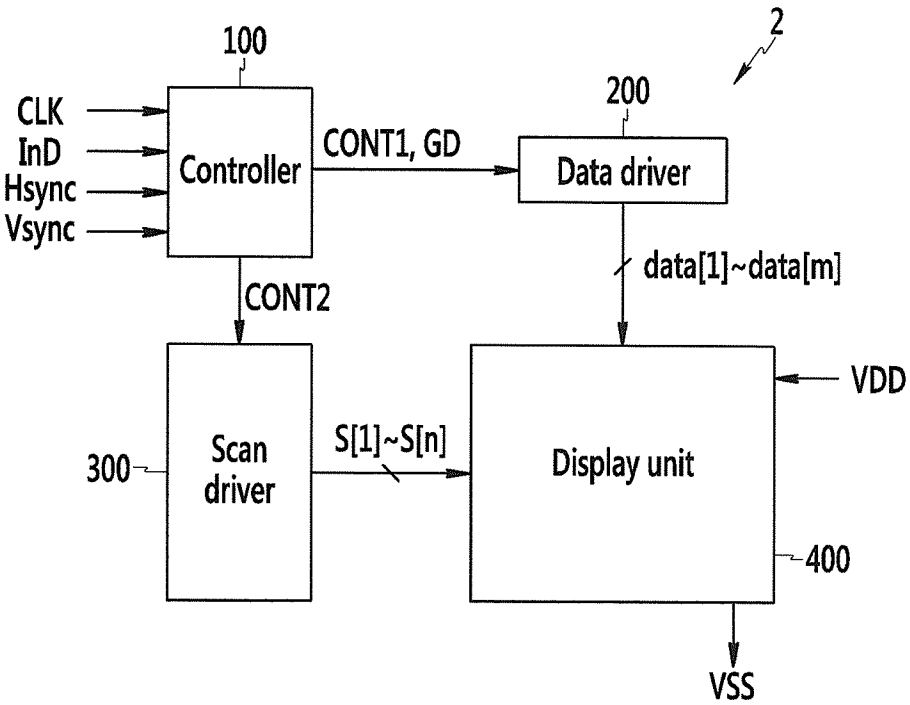
FIG. 3 is a view of an organic light emitting diode (OLED) display according to an exemplary embodiment of the present invention.

FIG. 3 is a view showing an organic light emitting diode (OLED) display 2 according to an exemplary embodiment of the present invention.

The gamma control mapping circuit 1 of the present invention is included in a controller 100 of the OLED display 2. As shown in FIG. 3, the display device 2 includes the controller 100, a data driver 200, a scan driver 300, and a display unit 400.

The controller 100 receives the input data InD and a synchronization signal, and generates first and second driving control signals CONT1 and CONT2 and grayscale data GD. The synchronization signal includes a horizontal synchronization signal Hsync, a vertical synchronization signal Vsync, and a main clock signal CLK.

The controller 100 divides the input data InD by a frame unit according to the vertical synchronization signal Vsync, and the input data InD by a scan line unit according to the horizontal synchronization signal Hsync, to generate grayscale data GD and transmit it to the data driver 200 along with the first driving control signal CONT1. The controller 100 includes the above-described gamma control mapping circuit 1. The grayscale data GD generated from the gamma control mapping circuit 1 are arranged per frame, and that as well as the line according to the horizontal synchronization signal Hsync and the vertical synchronization signal Vsync are transmitted to the data driver 200.

The data driver 200 samples and holds the grayscale data GD input according to the first driving control signal CONT1, and transmits a plurality of data signals data[1]-data[m] to a plurality of data lines according to the horizontal synchronization signal Hsync. The scan driver 300 generates a plurality of scan signals S[1]-S[n] and transmits them to corresponding scan lines according to the second driving control signal CONT2. The display unit 400 has a display area (or display region) including a plurality of pixels formed at crossing regions of a plurality of data lines for transmitting the plurality of data signals data[1]-data[m]) and a plurality of scan lines for transmitting the plurality of scan signals S[1]-S[n], and a plurality of wires connected to receive a first voltage VDD of a first voltage source and a second voltage VSS of a second voltage source to drive the plurality of pixels.

Figure 4:
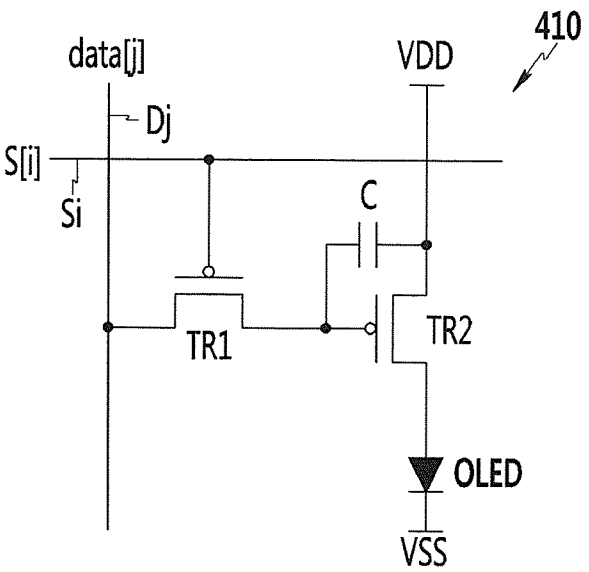
FIG. 4 is a view of a pixel among a plurality of pixels according to an exemplary embodiment of the present invention.

FIG. 4 is a view of one pixel 410 among the plurality of pixels according to an exemplary embodiment of the present invention. FIG. 4 shows the pixel 410 connected to the scan line Si transmitting the scan signal S[i] and the data line Dj transmitting the data signal data[j]. As shown in FIG. 4, the pixel 410 includes a switching transistor TR1, a driving transistor TR2, a capacitor C, and an organic light emitting diode (OLED).

The switching transistor TR1 and the driving transistor TR2 are realized by a PMOSFET transistor of a p-channel type, though the invention is not limited thereto. The switching transistor TR1 includes a gate electrode connected to the scan line Si, a source electrode connected to the data line Dj, and a drain electrode connected to the gate electrode of the driving transistor TR2. The driving transistor TR2 includes a source electrode connected to receive the first voltage VDD through a wire, a drain electrode connected to an anode of the organic light emitting diode (OLED), and the gate electrode receiving the data signal data[j] during a period in which the switching transistor TR1 is turned on. The capacitor C is connected to the gate electrode and the source electrode of the driving transistor TR2. The cathode of the organic light emitting diode OLED is connected to receive the second voltage VSS through a wire.

When the switching transistor TR1 is turned on by the scan signal S[i], the data signal data[j] is transmitted to the gate electrode of the driving transistor TR2. The voltage of the gate electrode of the driving transistor TR2 caused by the data signal data[j] is maintained by the capacitor C. The voltage difference between the gate electrode and the source electrode of the driving transistor TR2 is maintained by the capacitor C, and a driving current flows through the driving transistor TR2. The OLED emits light according to the driving current.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims, and equivalents thereof.

DESCRIPTION OF SELECTED SYMBOLS gamma control mapping circuit 1
boundary calculator 10
grayscale data calculator 20
separation unit 110
adder 120 and 240,
LUT 130
subtractor 210
divider 220
multiplier 230
input data InD
high-order bit data UbD1
grayscale region GR high-order grayscale boundary GBu
low-order grayscale boundary GBb
unit grayscale data GDU
low-order bit data BbD
linear grayscale data GDL
grayscale data GD
display device 2
controller 100
data driver 200
scan driver 300
display unit 400
horizontal synchronization signal Hsync
vertical synchronization signal Vsync
main clock signal CLK

What is claimed is:

1. A gamma control data mapping circuit for converting input data into grayscale data to display an original image on a display device, the gamma control data mapping circuit comprising:

a boundary calculator for separating the input data into high-order bit data and low-order bit data, and outputting a low-order grayscale boundary and a high-order grayscale boundary by using the high-order bit data; and a grayscale data calculator for dividing a grayscale region defined by the low-order grayscale boundary and the high-order grayscale boundary by a unit grayscale number to calculate unit grayscale data of the grayscale region, multiplying the low-order bit data by the unit grayscale data to calculate linear grayscale data, and adding the low-order grayscale boundary to the linear grayscale data to generate the grayscale data.

2. The gamma control data mapping circuit of claim 1, wherein the low-order grayscale boundary and the high-order grayscale boundary respectively correspond to the high-order bit data and modulation high-order bit data, and the modulation high-order bit data is generated by adding 1 to the high-order bit data.

3. The gamma control mapping circuit of claim 2, wherein the boundary calculator includes:

a separation unit for separating the input data into the high-order bit data and the low-order bit data;

an adder for generating the modulation high-order bit data from the high-order bit data; and a look-up table (LUT) for storing a plurality of grayscale boundaries comprising the low-order grayscale boundary and the high-order grayscale boundary, and respectively corresponding to the high-order bit data and the modulation high-order bit data.

4. The gamma control mapping circuit of claim 2, wherein the grayscale data calculator includes:

a subtractor for calculating a difference between the high-order grayscale boundary and the low-order grayscale boundary to calculate the grayscale region;

a divider for dividing the grayscale region by the unit grayscale number to calculate the unit grayscale data;

a multiplier for multiplying the low-order bit data by the unit grayscale data to calculate the linear grayscale data; and an adder for adding the low-order grayscale boundary to the linear grayscale data to calculate the grayscale data.

5. A method for a gamma control data mapping for converting input data into grayscale data to display an original image on a display device, the method comprising:

separating the input data into high-order bit data and low-order bit data;

outputting a low-order grayscale boundary and a high-order grayscale boundary by using the high-order bit data;

dividing a grayscale region defined by the low-order grayscale boundary and the high-order grayscale boundary by a unit grayscale number to calculate unit grayscale data of the grayscale region;

multiplying the low-order bit data by the unit grayscale data to calculate linear grayscale data; and adding the low-order grayscale boundary to the linear grayscale data to generate the grayscale data.

6. The method of claim 5, wherein the low-order grayscale boundary and the high-order grayscale boundary respectively correspond to the high-order bit data and modulation high-order bit data, and the modulation high-order bit data is generated by adding 1 is to the high-order bit data.

7. The method of claim 6, further comprising:

generating the modulation high-order bit data from the high-order bit data; and looking up the low-order grayscale boundary and the high-order grayscale boundary by respectively using the high-order bit data and the modulation high-order bit data from a look-up table (LUT) for storing a plurality of grayscale boundaries corresponding to the high-order bit data and the modulation high-order bit data.

8. A display device comprising:

a display unit including a plurality of data lines, a plurality of scan lines, and a plurality of pixels at crossing regions of the data lines and the scan lines, each of the pixels being connected to a corresponding one of the data lines and a corresponding one of the scan lines;

a data driver for transmitting a plurality of data signals to the data lines;

a scan driver for transmitting a plurality of scan signals to the scan lines; and a controller for separating input data into high-order bit data and low-order bit data, outputting a low-order grayscale boundary and a high-order grayscale boundary of a grayscale region corresponding to a range of the input data by using the high-order bit data, multiplying the low-order bit data by unit grayscale data calculated by dividing a difference between the low-order grayscale boundary and the high-order grayscale boundary by a unit grayscale number to calculate linear grayscale data, and adding the low-order grayscale boundary to the linear grayscale data to generate the grayscale data, wherein the data driver is configured to generate the plurality of data signals according to the grayscale data.

9. The display device of claim 8, wherein the low-order grayscale boundary and the high-order grayscale boundary respectively correspond to the high-order bit data and modulation high-order bit data, and the modulation high-order bit data is generated by adding 1 to the high-order bit data.

10. The display device of claim 9, wherein the controller includes:

a separation unit for separating the high-order bit data and the low-order bit data among the input data;

an adder for generating the modulation high-order bit data from the high-order bit data; and a look-up table (LUT) for storing a plurality of grayscale boundaries comprising the low-order grayscale boundary and the high-order grayscale boundary, and respectively corresponding to the high-order bit data and the modulation high-order bit data.

11. The display device of claim 9, wherein the controller includes:

a subtractor for calculating a difference between the high-order grayscale boundary and the low-order grayscale boundary to calculate the grayscale region;

a divider for dividing the grayscale region by the unit grayscale number to calculate the unit grayscale data;

a multiplier for multiplying the low-order bit data by the unit grayscale data to calculate the linear grayscale data; and an adder for adding the low-order grayscale boundary to the linear grayscale data to calculate the grayscale data.

* * * * *

UNITED STATES PATENT AND TRADEMARK OFFICE

CERTIFICATE OF CORRECTION

PATENT NO. : 8,605,125 B2
APPLICATION NO. : 13/240841
DATED : December 10, 2013
INVENTOR(S) : In-Hwan Kim et al.

It is certified that error appears in the above-identified patent and that said Letters Patent is hereby corrected as shown below:

In the Claims

Column 10, line 19, Claim 6 Delete "is"

Signed and Sealed this
Fourteenth Day of July, 2015

Michelle K. Lee

Michelle K. Lee
*Director of the United States Patent and Trademark Office*